United States Patent [19]

Robinson

[11] Patent Number: 4,480,593

[45] Date of Patent: Nov. 6, 1984

[54] METHOD AND COMPOSITION TO AVOID ASH BUILD-UP

[75] Inventor: David W. Robinson, Great Falls, Mont.

[73] Assignee: Robinson Insulation Co., Great Falls, Mont.

[21] Appl. No.: 396,648

[22] Filed: Jul. 9, 1982

[51] Int. Cl.[3] ..... F22B 37/18; F22B 37/48

[52] U.S. Cl. ..... 122/379; 110/345; 406/144; 122/392

[58] Field of Search ..... 406/144; 110/345; 122/379, 390, 392

[56] References Cited

U.S. PATENT DOCUMENTS

| | | | |
|---|---|---|---|
| 1,473,757 | 11/1923 | Dorsey | 406/144 |
| 3,206,255 | 9/1965 | Gray | 406/144 X |
| 3,237,805 | 3/1966 | Stogner | 406/144 X |
| 3,504,945 | 4/1970 | Leibundgut et al. | 406/144 |
| 4,109,861 | 8/1978 | McHugh | 406/144 X |
| 4,369,719 | 1/1983 | Engstrom et al. | 110/345 |

*Primary Examiner*—Edward G. Favors

*Attorney, Agent, or Firm*—Emrich & Dithmar

[57] ABSTRACT

A composition including exfoliated vermiculite and ash produces a soft clinker deposit. In a method to remove ash deposits from furnace structures, vermiculite is added to the gases and ash produced during a combustion process and combines with the ash forming deposits. The vermiculite-ash deposit is softer than a pure ash deposit and can be removed by the application of jets of steam to the furnace structures. An apparatus, used to preheat and inject vermiculite into furnace structures, includes a housing having walls defining a passage. The housing has a distal portion for projecting into containment vessel holding combustion gases and a proximal portion for receiving hot gas under pressure. The passage within the proximal portion includes a narrow section, a tapered section and a wide section. The tapered section has an opening for communicating with a source of vermiculite and for withdrawing the vermiculite as high velocity hot gas is directed into the narrow section, through the tapered section and out the wide section by a venturi effect. The vermiculite mixes with the hot gas as the vermiculite and hot gas exit through the wide section of said proximal portion and out the distal portion of the housing.

9 Claims, 3 Drawing Figures

METHOD AND COMPOSITION TO AVOID ASH BUILD-UP

BACKGROUND OF THE INVENTION

Coal fired steam generating furnaces have become more efficient by increasing the temperature of the steam produced in the super heat section of the boiler. Boilers, particularly tubing within the boiler, have been improved so as to no longer be a limiting factor in obtaining high temperatures. In coal fired steam generating furnaces the limiting factor in obtaining high temperatures in the super heat section of the steam boiler is the build-up of ash produced by the combustion of coal, often referred to as clinker, on the boiler tubes.

The fine ash produced by the combustion of the coal is normally carried with the combustion products through the maze of boiler tubes. However, if the boiler tubes are hot enough to exceed the fluxing temperature of the ash, the ash will adhere to the tubes much the same as snow being driven onto a warm masonry wall. The ash deposited on the boiler tubes has an insulating effect and can build-up to the point of interfering with the movement of combustion gases through the furnace.

Ash build-up on the tubes is usually detected by measuring and comparing the pressure of combustion gases as they pass through the banks of tubes. A reduction of pressure above the banks of tubes indicates a build up of ash or clinker on the boiler tubes. As the magnitude of the pressure drop increases, the rate of steam production must drop and the efficiency and the capacity of the boiler system is diminished.

Coal of the type producing a relatively low amount of ash upon combustion has been used to reduce the amount of ash deposited on the boiler tubes. However, the sodium content of low ash coal is often higher than the sodium content of high ash coals. Sodium lowers the melting temperature or softing temperatures of the uncombustible components making up the ash; the higher the sodium content the lower the softing temperature. Thus, a coal with an average ash content of nine percent may have a considerably higher sodium to ash ratio than a coal with an average ash content of seventeen percent ash. The lower ash coal may actually build up more ash deposit on the boiler tubes in a given time than the higher ash content coal.

Eventually, the boiler tubes must be cleaned to remove the ash build-up and return the boiler system to operating efficiency. Normally, high pressure steam jets are directed at the boiler tubes to blast away and break loose the deposits of ash. Deposits of ash that are resistant to the high pressure steam jets may be shot at with shotgun shells. Normally, shotgun shells are satisfactory to dislodge enough of the ash deposits to allow the boiler system to operate at normal efficiency; however, there are disadvantages to the use of shotgun shells to dislodge ash deposits. There are inherent dangers in firing a shotgun within the confines of a furnace at overhead metal structures. It requires skillful aim to dislodge a deposit of ash from boiler tubes. Shotgun shells are expensive and even with good aim a large number of shells may be required. Firing from a close range, to improve the efficiency of the operation, may damage or puncture boiler tubes.

Under the worst conditions, the furnace must be shut down and the boiler tubes cooled to allow them to be manually shaken and scraped. The manual cleaning of the boiler tubes is a dangerous and time consuming operation. Further, the operation is extremely costly and causes a disruption in the production of power for the duration of shutdown.

BRIEF SUMMARY OF THE INVENTION

The present invention facilitates the removal of ash deposits from boiler tubes of steam generating furnaces by a method, an apparatus and a composition of ash which will make a softer deposit on the tubes. A soft deposit of ash on the boiler tubes can be more readily removed with periodic use of steam jets or other removing means.

An embodiment of the invention provides for a composition of vermiculite and ash to form a soft clinker deposit on furnace structures. When raw vermiculite is added to gases of combustion, the vermiculite exfoliates and combines with the ash which can form clinker deposits on the furnace apparatus. The void spaces of the exfoliated vermiculite weaken the ash deposits such that the deposits can be dislodged with a minimum of physical agitation.

Thus, an embodiment of the present invention would include a method of removing ash deposits from furnace structures having a first step of adding vermiculite to the gases and ash formed during a combustion process. The soft vermiculite-ash deposit can be removed with steam jets which are well suited to knock the soft deposits free of the furnace structure.

A further embodiment of the invention provides for an apparatus for the efficient addition of vermiculite into the hot gases of combustion. The apparatus includes a vermiculite feed nozzle having a hollow housing defining a passage having a distal portion for projecting into hot gases and a proximal portion for receiving steam under pressure. The passage within the proximal portion includes a narrow section, a tapered section, and a wide section. The tapered section has an opening extending vertically upward for communicating with a source of vermiculite. A funnel chamber communicates with the opening of the tapered section for storing vermiculite and directing the vermiculite into the opening. Hot steam is directed through the narrow section and into the tapered section. Vermiculite is drawn from the funnel chamber and mixes with the steam as the steam exits through the wide section of the proximal portion and out the distal portion of the housing. During the mixing of the vermiculite and steam, the steam initiates the exfoliation of the vermiculite. The latent heat of vaporization of the steam is rapidly absorbed by the vermiculite providing a further impetus to expand.

Other features and advantages of the present invention will be apparent from the following description and claims and are illustrated in the accompanying drawings which by way of illustration show a preferred embodiment of the present invention and the principles thereof and what is now considered to be the best mode in which to apply these principles. Other embodiments of the invention employ the same or equivalent principles may be used and structural changes may be made as desired to those skilled in the art without departing from the present invention and the purview of the appended claims.

DETAILED DESCRIPTION

Figure 1:
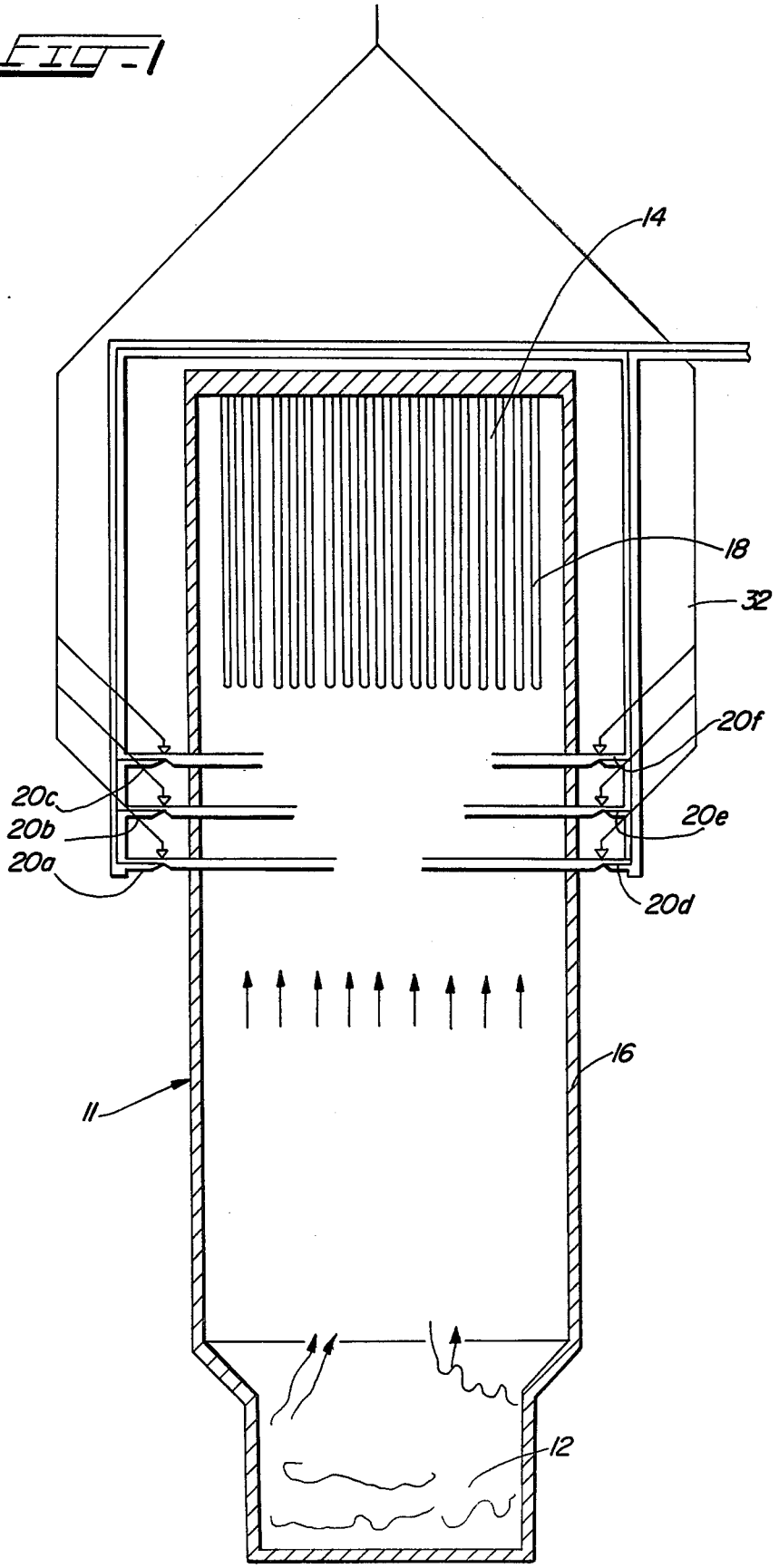
FIG. 1 is a sectional side perspective view of a boiler assembly incorporating an anti-ash fouling vermiculite feed nozzle of the present invention.

An embodiment of the invention provides for a composition of vermiculite and ash to form a soft clinker deposit on furnace structures. Vermiculite is a generic term for a group of minerals with water of crystallization which belong to the mica group. Vermiculite exists in a raw form or in an expanded, exfoliated form. The expanded form of vermiculite is often used as a loose insulation, a filler, or a packing material. The raw form of vermiculite is converted to the expanded or exfoliated form when subjected to rapid heating. Rapid heating releases the water of crystallization, held within the hydrated magnesium-aluminum-iron silicate comprising vermiculite, as steam separating and expanding layers of the vermiculite. Exfoliated vermiculite has a very high ratio of void spaces to its volume. When raw vermiculite is added to gases of combustion, the vermiculite exfoliates and combines with the ash which can form clinker deposits on the furnace apparatus. The void spaces of the exfoliated vermiculite weaken the ash deposits such that the deposits can be dislodged with a minimum of physical agitation.

Thus, an embodiment of the present invention would include a method of removing ash deposits from furnace structures having a first step of adding vermiculite to the gases and ash formed during a combustion process. The vermiculite combines with the ash to form a soft vermiculite-ash deposit. The soft vermiculite-ash deposit can be removed with steam jets which are well suited to knock the soft deposits free of the furnace structure.

Although the invention has great application in furnaces where jets of steam are used to remove ash deposits, it will be readily recognized by those skilled in the art that the soft vermiculite-ash deposits can be readily removed by other means. Those skilled in the art will also recognize that raw vermiculite is used as a starting material only because its smaller bulk makes it easier to handle and the heat of the combustion process will generally cause the vermiculite to exfoliate without additional steps. It is within the purview of the present invention to use exfoliated vermiculite as a starting material.

The amount of ash produced on combustion, the content of the ash, and the temperature of the boiler tubes, influence the amount of vermiculite necessary to produce a soft vermiculite-ash deposit. For example, one ton of coal having a high ash content of approximately seventeen percent but also having a relatively low sodium content may require approximately 0.9 kilograms (two pounds U.S. measure) of vermiculite added to the ash produced upon combustion to produce a soft deposit. One ton of coal having a low ash content of approximately nine percent with a higher sodium content may require approximately 1.6 kilograms (3.5 pounds U.S. measure) of vermiculite added to the ash produced on combustion to produce a soft deposit. Some coals with high ash and high sodium content may require as much as 2.3 kilograms (5 pounds U.S. measure) of vermiculite added to the ash produced on combustion of one ton of coal to produce a soft deposit.

Stated in a different manner, for high ash coal with low sodium content and a corresponding high softening temperature, the resultant soft vermiculite-ash deposit has a unit volume ratio of one part vermiculite to ten parts ash (10% vermiculite by volume). With coal having low ash properties, but having a high sodium content and a corresponding low softening temperature, the resultant soft vermiculite-ash deposit has a unit volume ratio of one part vermiculite to two parts ash (33% vermiculite by volume). Thus, using the values given as a guide, it is possible to optimize the amount of vermiculite used for coals of different ash and sodium content within the parameters given and beyond.

Although vermiculite is cost effective in solving the ash deposit problem in coal fired steam generating plants, the cost of vermiculite is appreciable. The use of vermiculite in particle sizes in the range of −20 to +100 mesh optimizes its use. Courser particles, outside the range, do not rapidly and uniformly heat and consequently do not exfoliate to as great a degree. Smaller particles do not exfoliate as well because they do not trap water of crystallization within layers to as great of degree.

To further optimize the use of vermiculite, an embodiment of the invention includes preheating the vermiculite in a high velocity high temperature gas immediately prior to injecting the vermiculite into the boiler combustion gases. By preheating the vermiculite, the volume of vermiculite developed from a unit weight of vermiculite can be increased by twenty to thirty percent over other means of introduction, such as air conveyance or by gravity feed. Introduction by means of air conveyance or gravity feed heats the vermiculite to exfoliation temperatures slower, thus reducing its expansion capabilities. Preheating the vermiculite in a high velocity high temperature gas imparts an impetus to exfoliation which is continued by the furnace combustion gases. Preheating the vermiculite increases the rate of release of the water of crystallization in the form of steam within the particles of vermiculite, forcing the layers of vermiculite apart to a greater extent.

Steam is particularly effective when used to preheat vermiculite. The latent heat of vaporization of the steam is rapidly absorbed by the cold vermiculite as it contacts the jet of steam. In order to be efficient, the steam must be in excess of 400 degrees Fahrenheit. Efficiency is further improved as the temperature is further increased; however, practical limitations limit the most efficient temperature of steam to about 600 degrees Fahrenheit.

Turning now to the drawings, an embodiment of the present invention will be described in detail as a vermiculite feed nozzle apparatus for injecting vermiculite and steam into hot gases, with the understanding that the present disclosure is to be considered an exemplification of the principles of the invention and is not intended to limit the embodiment illustrated.

Referring now to FIG. 1, vermiculite feed nozzles 20A–F of the subject invention, are shown mounted in a wall 16 of a boiler assembly 11. The boiler assembly includes a lower fire box area 12 which shunts hot combustion gases outward into a boiler chamber 15 and over boiler tubing 18 of the secondary super heater 14.

Projecting inwardly through the boiler wall 16 below the boiler tubing 18 of the secondary super heater 14 are six vermiculite feed nozzles 20A–F which inject vermiculite into the hot gases of the boiler chamber 15. The injected vermiculite mixes with the hot gases of combustions and the ash carried with the combustion by-products to combine with the ash depositing on the boiler tubes 14 producing a soft ash deposit of vermiculite and ash.

Figure 2:
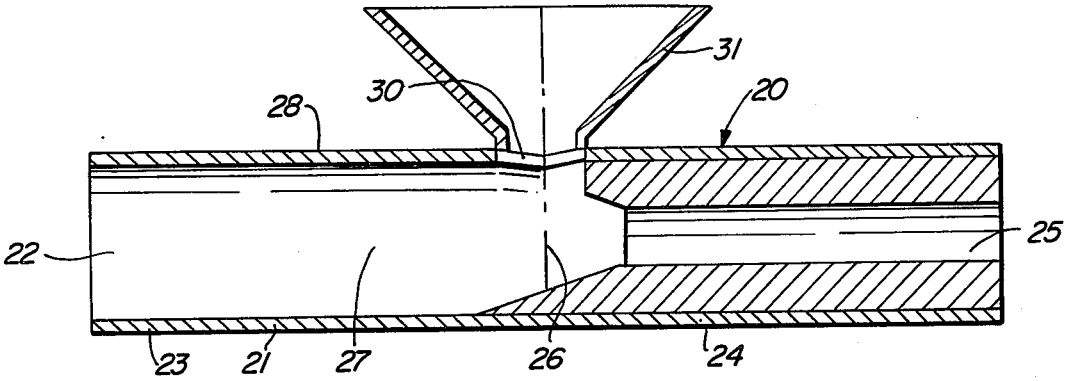
FIG. 2 is a sectional side perspective view of an individual anti-ash fouling vermiculite feed nozzle of the present invention.
Figure 3:
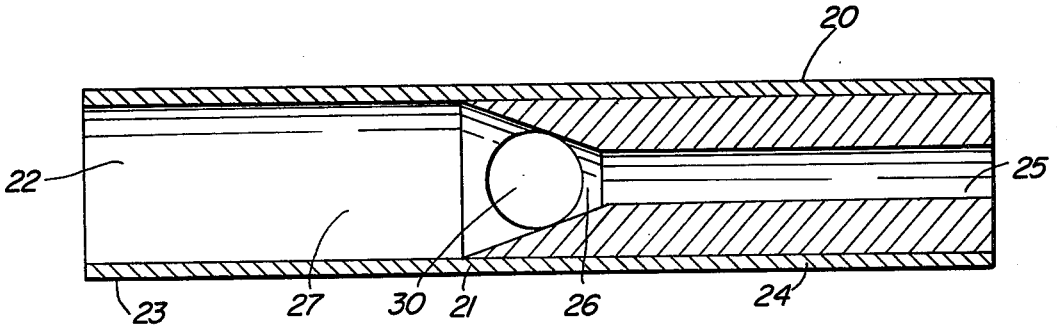
FIG. 3 is a sectional bottom perspective view of an individual anti-ash fouling vermiculite feed nozzle of the present invention.

The vermiculite feed nozzle 20 of the present invention, as illustrated in greater detail in FIGS. 2 and 3, includes a housing 21 having walls 28 defining a passage 22. The housing 21 has a distal portion 23 for projecting into the hot gases in the boiler chamber, and proximal portion 24 for receiving steam or other hot gases under pressure. The passage 22 within the proximal portion 24 of the housing 21 includes a narrow section 25, a tapered section 26 and a wide section 27. The tapered section 26 has an opening 30 for communicating with a source of vermiculite and for withdrawing the vermiculite as high velocity steam or hot gas is directed through the narrowed section 25, through the tapered section 26 and into the wide section 27 be a venturi effect. The vermiculite mixes with the hot gas as the vermiculite and hot gas exit through the wide section 27 of the proximal portion 24 and out the distal portion 23 of the housing 21. During the mixing, the vermiculite is exposed to rapid heating, and exfoliates and expands prior to entering the boiler chamber 15. The expansion of the vermiculite is completed in the boiler chamber 15 as the vermiculite mixes with the hot gases and ash of combustion.

The opening 30 in the tapered section 26 extends vertically upward to allow gravity to assist the venturi effect in pulling vermiculite downward into the passage 22. A funnel chamber 31 is affixed to the housing 21 in communication with the opening 30 in the tapered section 26. The funnel chamber 31 stores the vermiculite and directs the vermiculite into the opening 30. Normally, the funnel chamber 31 is in communication with a vermiculite feed system in the form of a conveyor which feeds vermiculite to the funnel chamber 31 from a central stock pile as shown schematically as numeral 32 in FIG. 1.

In operation, as can best be seen in FIG. 1, vermiculite is fed to the funnel chamber 31 by a vermiculite feed system 32. Referring now to FIG. 2, vermiculite stored in the funnel chamber 31 is withdrawn by a venturi effect through opening 30 as steam is forced through the narrow section 25, through the tapered section 26 and into the wide section 27 of the passage 22 within the proximal portion 24 of the housing 21 of the vermiculite feed nozzle 20. Vermiculite and steam mix as they pass through the wide section 27 of the proximal portion 24 and through the distal portion 23 of the housing 21. During the mixing process the vermiculite absorbs the latent heat of vaporization of the steam and rapidly exfoliates.

Returning now to FIG. 1, the initial rapid impetus to exfoliate is continued as the vermiculite is injected into the boiler chamber 15 and mixed with the hot gases and ash of combustion. The exfoliated vermiculite and ash mix and rise in the boiler chamber 15 where they contact the boiler tubes 18 of the secondary super heater 14.

The greater void volume of vermiculite injected into the boiler gases by means of the vermiculite feed nozzle 20 of the present invention is 10 to 30 percent more efficient than when the vermiculite is merely piped into the boiler chamber 15 by pressurized air. The soft vermiculite and ash deposit formed on the boiler tubes 18 are readily removed by jets of steam.

From the foregoing, it will be seen that the present invention provides a safe and efficient method and composition for reducing ash deposits within coal fired steam generating furnaces. While the preferred embodiment of the invention have been described, it is understood that these are capable of variation and modification, and therefore the present invention should not be limited to the precise details set forth, but should include changes and alterations that fall within the purview of the following claims.

I claim:

1. A vermiculite feed apparatus, for injecting vermiculite and hot gas into a containment vessel having boiler tubes therein and containing combustion gases therein, comprising:

a housing having walls defining a passage therethrough, said housing having a distal portion for projecting into the gases of combustion and a proximal portion, said passage within said proximal portion of said housing including a narrow section, a tapered section having a cross-section of increasing diameter and a wide section, said narrow section for receiving hot gas under pressure and directing said hot gas into said tapered section, said tapered section further having an opening for communicating with a source of vermiculite and for withdrawing said vermiculite as high velocity hot gas is directed through said tapered section portion and into said wide section, said vermiculite mixing with said hot gas to exfoliate said vermiculite as said vermiculite and hot gas exit through said wide section of said proximal portion and out said distal portion of said housing into the combustion gases in the containment vessel for contact with the boiler tubes within the containment vessel.

2. The apparatus of claim 1 further comprising:

a funnel chamber in communication with said opening in said tapered section for storing vermiculite and directing vermiculite into said opening.

3. The apparatus of claim 1 wherein said opening in said tapered section extends vertically upward.

4. The apparatus of claim 1 wherein said opening in said tapered section extends vertically upward, and further comprising a funnel chamber in communication with said opening for storing vermiculite and directing vermiculite into said opening.

5. The apparatus of claim 4 further comprising a vermiculite feed means for conveying vermiculite to said funnel chamber.

6. The apparatus of claim 1 further comprising a source of steam in communication with said narrow section of said proximal portion of said housing.

7. An apparatus for producing soft ash deposits in coal fired steam generating furnaces containing gases of combustion and for removing the soft ash deposits therefrom, comprising:

a vermiculite feed nozzle;

said feed nozzle having walls defining a passage therethrough, said nozzle having a distal portion for projecting into the gases of combustion in the furnace and a proximal portion, said passage within said proximal portion of said nozzle including a narrow section, a tapered section having a cross-section of increasing diameter and a wide section, said narrow section for receiving hot gas under pressure and directing said hot gas into said tapered section, said tapered section further having an opening extending vertically upward for communicating with a source of vermiculite and for withdrawing said vermiculite as high velocity hot gas is directed through said tapered section portion and into said wide section, said vermiculite mixing with said hot gas to exfoliate said vermiculite as said vermiculite and hot gas exit through said wide section of said proximal portion and out said distal portion of said nozzle for mixing with the gases of combustion and forming said soft ash deposit in the furnace;

a funnel chamber in communication with said opening in said tapered section for storing vermiculite and directing vermiculite into said opening;

a vermiculite feed means for conveying vermiculite to said funnel chamber; and removal means to free said soft ash deposit from the furnace.

8. The apparatus of claim 7 wherein said removal means include jets of steam directed onto the soft ash deposits.

9. The apparatus of claim 7 further comprising a source of steam in communication with said narrow section of said proximal portion of said nozzle for exfoliating the vermiculite in said wide section of said nozzle.

* * * * *